US011004388B2

(12) United States Patent
Li et al.

(10) Patent No.: US 11,004,388 B2
(45) Date of Patent: May 11, 2021

(54) PIXEL CIRCUITRY AND DRIVING METHOD THEREOF, ARRAY SUBSTRATE AND DISPLAY DEVICE

(71) Applicant: BOE TECHNOLOGY GROUP CO., LTD., Beijing (CN)

(72) Inventors: Junjie Li, Beijing (CN); Peng Cai, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 148 days.

(21) Appl. No.: 16/336,346

(22) PCT Filed: Jun. 19, 2018

(86) PCT No.: PCT/CN2018/091814
§ 371 (c)(1),
(2) Date: Mar. 25, 2019

(87) PCT Pub. No.: WO2018/233599
PCT Pub. Date: Dec. 27, 2018

(65) Prior Publication Data

US 2019/0304367 A1 Oct. 3, 2019
US 2020/0312242 A9 Oct. 1, 2020

(30) Foreign Application Priority Data

Jun. 22, 2017 (CN) ..... 201710481256.2

(51) Int. Cl.
*G09G 3/3233* (2016.01)
*G09G 3/3258* (2016.01)
*G09G 3/3291* (2016.01)

(52) U.S. Cl.
CPC ..... *G09G 3/3233* (2013.01); *G09G 3/3258* (2013.01); *G09G 3/3291* (2013.01);
(Continued)

(58) Field of Classification Search
CPC ..... G09G 2300/043; G09G 2300/0809; G09G 2300/0819; G09G 2300/0842;
(Continued)

(56) References Cited

U.S. PATENT DOCUMENTS

2007/0103419 A1 5/2007 Uchino et al.
2010/0194716 A1* 8/2010 Park ..... G09G 3/3233 345/204
(Continued)

FOREIGN PATENT DOCUMENTS

CN 103474025 A 12/2013
CN 103927981 A 7/2014
(Continued)

OTHER PUBLICATIONS

PCT International Search Report, Application No. PCT/CN2018/091814, dated Sep. 5, 2018, 5 pages: with English translation.
(Continued)

*Primary Examiner* — Richard J Hong
(74) *Attorney, Agent, or Firm* — Armstrong Teasdale LLP

(57) ABSTRACT

Embodiments of the present disclosure provide a pixel circuitry and a driving method thereof. In the pixel circuitry, the reset circuit provides an initialization signal to a first node and one end of the light emitting device based on a reset signal. The driving transistor provides a driving current based on the voltage of the first node. The data signal write circuit provides a data signal to a third node based on a strobe signal. The compensation circuit couples a second node to the first node based on the strobe signal. The voltage supply circuit provides a first voltage signal to the second node based on a control signal. The control circuit provides a driving current provided by the driving transistor to the light emitting device based on the control signal. The light emitting device emits light according to the driving current.

11 Claims, 10 Drawing Sheets

(52) U.S. Cl.
CPC ..... *G09G 2300/043* (2013.01); *G09G 2300/0809* (2013.01)

(58) Field of Classification Search
CPC ..... G09G 2300/0861; G09G 3/3233; G09G 3/3258; G09G 3/3291; G09G 3/3266; G09G 3/3208; H01L 27/323; H01L 27/3262; H05B 45/60
See application file for complete search history.

(56) References Cited

U.S. PATENT DOCUMENTS

| | | | | |
|---|---|---|---|---|
| 2011/0069058 | A1* | 3/2011 | Chung | G09G 3/3233 345/212 |
| 2011/0156611 | A1* | 6/2011 | Tsai | H05B 45/60 315/291 |
| 2015/0356917 | A1 | 12/2015 | Huang et al. | |
| 2016/0063921 | A1* | 3/2016 | Tsai | G09G 3/3233 345/76 |
| 2016/0063922 | A1 | 3/2016 | Tsai et al. | |
| 2016/0189610 | A1* | 6/2016 | Xiao | G09G 3/3233 345/77 |
| 2017/0365213 | A1* | 12/2017 | Rieutort-Louis | G09G 3/3233 |
| 2018/0144684 | A1* | 5/2018 | Jeon | G09G 3/3266 |
| 2018/0204889 | A1* | 7/2018 | Yu | H01L 27/323 |
| 2018/0218681 | A1* | 8/2018 | Cai | G09G 3/3258 |
| 2018/0226026 | A1* | 8/2018 | Chen | G09G 3/3208 |
| 2020/0410934 | A1* | 12/2020 | Jeon | H01L 27/3262 |

FOREIGN PATENT DOCUMENTS

| | | | |
|---|---|---|---|
| CN | 104751799 | A | 7/2015 |
| CN | 105206222 | A | 12/2015 |
| CN | 105575327 | A | 5/2016 |
| CN | 105679236 | A | 6/2016 |
| CN | 105989805 | A | 10/2016 |
| CN | 106128360 | A | 11/2016 |
| CN | 107068066 | A | 8/2017 |
| KR | 20130026338 | A | 3/2013 |

OTHER PUBLICATIONS

PCT Written Opinion, Application No. PCT/CN2018/091814, dated Sep. 5, 2018, 6 pages.: with English translation of relevant part.
China First Office Action, Application No. 201710481256.2, dated Sep. 19, 2018, 22 pps.: with English translation.
China Second Office Action, Application No. 201710481256.2, dated Oct. 29, 2018, 20 pps.: with English translation.

* cited by examiner

PIXEL CIRCUITRY AND DRIVING METHOD THEREOF, ARRAY SUBSTRATE AND DISPLAY DEVICE

CROSS REFERENCE TO RELATED APPLICATIONS

This patent application is a National Stage Entry of PCT/CN2018/091814 filed on Jun. 19, 2018, which claims the benefit and priority of Chinese Patent Application No. 201710481256.2 filed on Jun. 22, 2017, the disclosures of which are incorporated by reference herein in their entirety as part of the present application.

BACKGROUND

Embodiments of the present disclosure relate to the field of pixel circuitry technology, and in particular, to a pixel circuitry, an array substrate, a display device, and a driving method.

With the advancement of display technology, compared with conventional liquid crystal display (LCD) devices, a new generation of organic light emitting diode (OLED) display devices has lower manufacturing cost, a faster response speed, higher contrast, a wider viewing angle, a larger operating temperature range, bright colors, light weight, and thin thickness, without a backlight unit. Therefore, the OLED display technology has become the fastest growing display technology.

BRIEF DESCRIPTION

Embodiments of the present disclosure provide a pixel circuitry, an array substrate, a display device, and a driving method.

A first aspect of the present disclosure provides a pixel circuitry. The pixel circuitry may include a reset circuit, a driving transistor, a data signal write circuit, a compensation circuit, a voltage supply circuit, a control circuit, and a light emitting device. The reset circuit may provide an initialization signal from an initialization signal input terminal to a first node and one end of the light emitting device under the control of a reset signal from a reset signal input terminal. A control electrode of the driving transistor is coupled to the first node, a first electrode of the driving transistor is coupled to a second node, a second electrode of the driving transistor is coupled to a third node, and the driving transistor may provide a driving current under the control of a voltage of the first node. The data signal write circuit may provide a data signal from a data signal input terminal to the third node under the control of a strobe signal from a strobe signal input terminal. The compensation circuit may couple the second node to the first node under the control of the strobe signal. The voltage supply circuit may provide a first voltage signal from a first voltage signal input terminal to the second node under the control of a control signal from a control signal input terminal. The control circuit may provide a driving current provided by the driving transistor to the light emitting device under the control of the control signal. The light emitting device may emit light according to the driving current.

In an embodiment of the present disclosure, the reset circuit may include a first transistor and a second transistor. A control electrode of the first transistor is coupled to the reset signal input terminal, a first electrode of the first transistor is coupled to the initialization signal input terminal, and a second electrode of the first transistor is coupled to the first node. A control electrode of the second transistor is coupled to the reset signal input terminal, a first electrode of the second transistor is coupled to the initialization signal input terminal, and a second electrode of the second transistor is coupled to the light emitting device.

In an embodiment of the present disclosure, the data signal write circuit may include a third transistor. A control electrode of the third transistor is coupled to the strobe signal input terminal, a first electrode of the third transistor is coupled to the data signal input terminal, and a second electrode of the third transistor is coupled to the third node.

In an embodiment of the present disclosure, the compensation circuit may include a fourth transistor. A control electrode of the fourth transistor is coupled to the strobe signal input terminal, a first electrode of the fourth transistor is coupled to the second node, and a second electrode of the fourth transistor is coupled to the first node.

In an embodiment of the present disclosure, the voltage supply circuit may include a fifth transistor. A control electrode of the fifth transistor is coupled to the control signal input terminal, a first electrode of the fifth transistor is coupled to the first voltage signal input terminal, and a second electrode of the fifth transistor is coupled to the second node.

In an embodiment of the present disclosure, the control circuit may include a sixth transistor. A control electrode of the sixth transistor is coupled to the control signal input terminal, a first electrode of the sixth transistor is coupled to the third node, and a second electrode of the sixth transistor is coupled to the light emitting device.

In an embodiment of the present disclosure, the pixel circuitry may further include a voltage stabilization circuit. The voltage stabilization circuit is configured to stabilize the voltage of the first node.

In an embodiment of the present disclosure, the voltage stabilization circuit may include a capacitor. One end of the capacitor is coupled to the first voltage signal input terminal, and the other end of the capacitor is coupled to the first node.

A second aspect of the present disclosure provides a pixel circuitry. The pixel circuitry includes a first transistor, a driving transistor, a second transistor, a third transistor, a fourth transistor, a fifth transistor, a sixth transistor, and a light emitting device. A control electrode of the first transistor is coupled to a reset signal input terminal, a first electrode of the first transistor is coupled to an initialization signal input terminal, and a second electrode of the first transistor is coupled to a first node. A control electrode of the driving transistor is coupled to the first node, a first electrode of the driving transistor is coupled to a second node, and a second electrode of the driving transistor is coupled to a third node. A control electrode of the second transistor is coupled to the reset signal input terminal, a first electrode of the second transistor is coupled to the initialization signal input terminal, and a second electrode of the second transistor is coupled to the light emitting device. A control electrode of the third transistor is coupled to a strobe signal input terminal, a first electrode of the second transistor is coupled to a data signal input terminal, and a second electrode of the second transistor is coupled to the third node. A control electrode of the fourth transistor is coupled to the strobe signal input terminal, a first electrode of the fourth transistor is coupled to the second node, and a second electrode of the fourth transistor is coupled to the first node. A control electrode of the fifth transistor is coupled to a control signal input terminal, a first electrode of the fifth transistor is coupled to a first voltage signal input terminal, and a second electrode of the fifth transistor is coupled to the second node. A control electrode of the sixth transistor is coupled to the control signal input terminal, a first electrode of the sixth transistor is coupled to the third node, and a second electrode of the sixth transistor is coupled to the light emitting device. One end of the light emitting device is coupled to the second electrode of the sixth transistor.

In an embodiment of the present disclosure, the pixel circuitry may further include a capacitor. One end of the capacitor is coupled to the first voltage signal input terminal, and the other end of the capacitor is coupled to the first node.

A third aspect of the present disclosure provides a method for driving a pixel circuitry of the first or second aspect of the present disclosure. In the method, an initialization signal from an initialization signal input terminal is provided to a first node and one end of a light emitting device under the control of a reset signal from a reset signal input terminal. Under the control of a strobe signal from a strobe signal input terminal, a data signal from a data signal input terminal is provided to a third node, and a second node is coupled to the first node. Under the control of the voltage of the first node, a driving current is provided by a driving transistor, such that the driving current flows from the second node to the first node to increase the voltage of the first node. Then, a first voltage signal from a first voltage signal input terminal is provided to the second node under the control of a control signal from a control signal input terminal. Under the control of the voltage of the first node, a driving current is provided by the driving transistor, such that the light emitting device emits light according to the driving current.

A fourth aspect of the present disclosure provides an array substrate. The array substrate may include a plurality of pixel circuits of the first or second aspect of the present disclosure.

A fifth aspect of the present disclosure provides a display device. The display device may include the array substrate of the fourth aspect of the present disclosure.

BRIEF DESCRIPTION OF THE DRAWINGS

In order to illustrate the technical solutions of the embodiments of the present disclosure more clearly, the embodiments of the present disclosure can be briefly described below with reference to the accompanying drawings. Apparently, the drawings in the following description are merely illustrative of some embodiments of the present disclosure, and are not intended to limit the embodiments of the present disclosure. In the figures.

DETAILED DESCRIPTION

Figure 1:
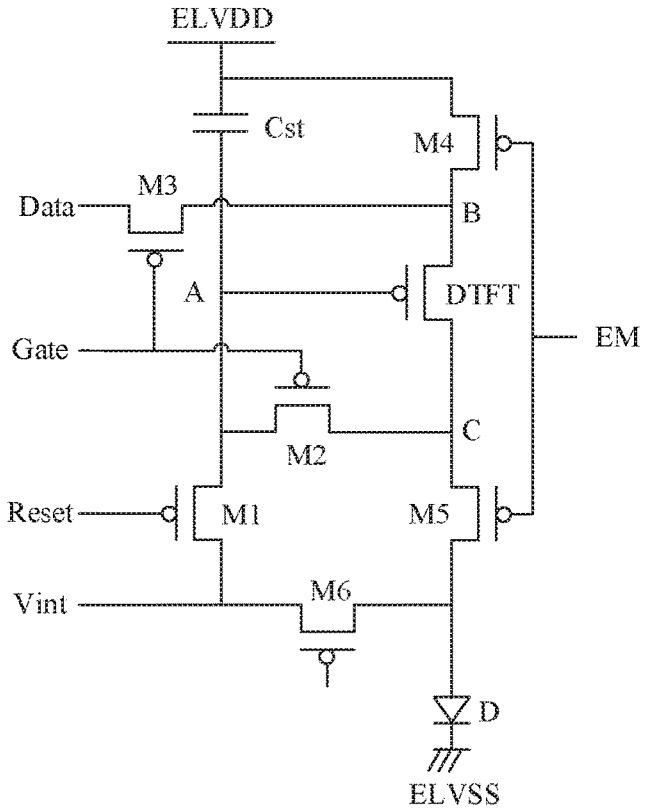
FIG. 1 is a schematic diagram of a circuit structure of a pixel circuitry.

In order to illustrate the technical solutions and advantages of the embodiments of the present disclosure clearer, the technical solutions of the embodiments of the present disclosure can be described clearly and completely below in conjunction with the accompanying drawings. Obviously, the described embodiments are only part of the embodiments of the present disclosure, not all of the embodiments. Based on the embodiments described, all other embodiments acquired by those of ordinary skill in the art without creative work also fall within the scope of protection of the present disclosure.

In the description of the present disclosure, the meaning of "a plurality" is two or more, unless otherwise stated; the orientation or positional relationship indicated by the term "upper", "lower", "left", "right", "inside", or "outside" is based on the orientation or positional relationship shown in the drawings, and is merely for the convenience of the description of the present disclosure and the simplification of the description, rather than suggesting or implying that the machine or component referred to has a specific orientation or is constructed and operated in a specific orientation, and therefore cannot be construed as limiting the present disclosure.

In the description of the present disclosure, it should be noted that the terms "mounted", "connected", and "coupled" are to be understood broadly, unless otherwise explicitly stated and defined, and may refer to, for example, a fixed connection or a detachable connection or an integral connection, may refer to a mechanical connection or an electrical connection, or may refer to a direct connection or an indirect connection through an intermediate medium. The specific meaning of the above terms in the present disclosure may be understood in a specific case by those skilled in the art.

Due to the market demand for flexible display, active-matrix organic light emitting diode (AMOLED) display technology gradually become more important than the traditional liquid crystal display (LCD) technology. At present, the mainstream driving method is low temperature polysilicon (LTPS) technology. However, as the film cannot be formed completely uniform, it is required to compensate the pixel circuit.

Figure 2:
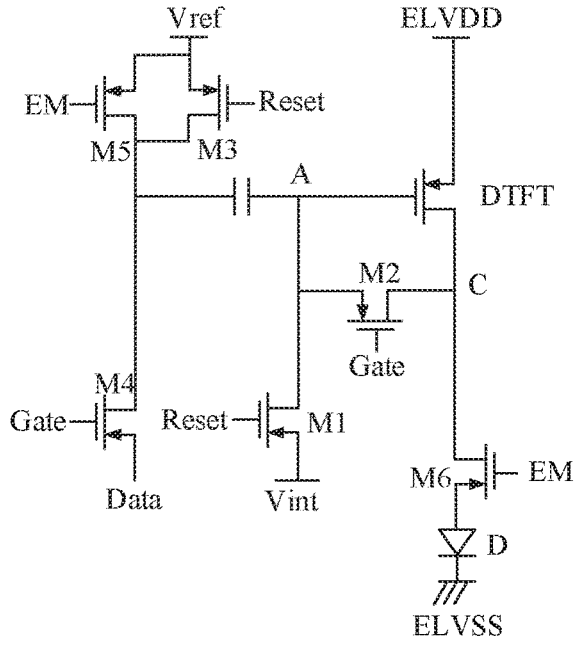
FIG. 2 is a schematic diagram of another circuit structure of the pixel circuitry.

FIGS. 1 and 2 show two designs for the pixel circuitry, respectively. The pixel circuitries shown in FIGS. 1 and 2 respectively include a first transistor M1, a second transistor M2, a third transistor M3, a fourth transistor M4, a fifth transistor M5, a sixth transistor M6, a driving transistor DTFT, and a capacitor Cst. The above devices can be coupled to a first voltage signal input terminal ELVDD, a data signal input terminal Data, a strobe signal input terminal Gate, a reset signal input terminal Reset, an initialization signal input terminal Vint, and a control signal input terminal EM as shown in the figures. The operating process of the pixel circuitry thus can be controlled.

For the two pixel circuitries, a cathode of a light emitting device D is coupled to a second voltage signal input terminal ELVSS (e.g., ground), and a anode of the light emitting device D receives a voltage signal provided by the first voltage signal input terminal ELVDD, such that the light emitting device D emits light. With a low gray scale, if the light emitting device D cannot emit light stably, display effect can be severely influenced. The stabilization of the voltage of the control electrode of the driving transistor DTFT is of importance to ensure uniform luminance of the light emitting device D.

Specifically, as shown in FIG. 1, the control electrode (e.g., gate) of the driving transistor DTFT in the pixel circuitry is coupled to a node A, the first electrode (e.g., source or drain) of the driving transistor DTFT is coupled to a node B, and the second electrode (e.g., drain or source) of the driving transistor DTFT is coupled to a node C. The node A is also coupled to the first electrode of the second transistor M2, and the node C is also coupled to the second electrode of the second transistor M2.

As shown in FIG. 2, the control electrode of the driving transistor DTFT in the pixel circuitry is coupled to the node A, the first electrode of the driving transistor DTFT is coupled to the first voltage signal input terminal ELVDD, and the second electrode of the driving transistor DTFT is coupled to the node C. The node A is also coupled to the first electrode of the second transistor M2, and the node C is also coupled to the second electrode of the second transistor M2.

When the light emitting device D emits light, the voltage of the node A is about the voltage VELVDD of the first voltage signal input terminal ELVDD, and the voltage of the node C is about 0, such that the voltage difference between the node A and the node C is large, and leakage current can be easily generated. Therefore, the voltage of the control electrode of the driving transistor DTFT is unstable, causing the emitted light unstable. In addition, in the pixel circuitry in FIG. 2, a writing position of the data signal input terminal Data is spaced far from the anode of the light emitting diode D. Therefore, layout for the circuitry is difficult.

Figure 3:
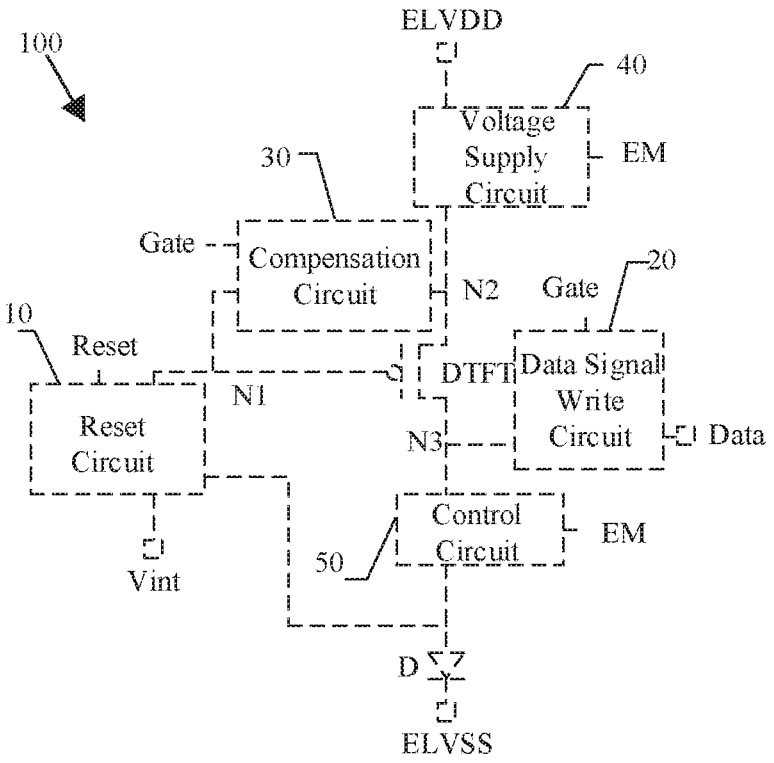
FIG. 3 is a schematic block diagram of a pixel circuitry according to an embodiment of the present disclosure.

FIG. 3 shows a schematic block diagram of a pixel circuitry according to some embodiments of the present disclosure. As shown in FIG. 3, the pixel circuitry 100 may include a reset circuit 10, a driving transistor DTFT, a data signal write circuit 20, a compensation circuit 30, a voltage supply circuit 40, a control circuit 50, and a light emitting device D.

In an embodiment of the present disclosure, the reset circuit 10 may be coupled to the reset signal input terminal, the initialization signal input terminal, the first node N1, and one end (e.g., the anode) of the light emitting device D, respectively. The reset circuit 10 may provide an initialization signal Vint to the first node N1 and one end (for example, the anode) of the light emitting device D, under the control of a reset signal Reset from the reset signal input terminal, respectively.

A control electrode (e.g., gate) of the driving transistor DTFT is coupled to the first node N1, a first electrode (e.g., source or drain) of the driving transistor DTFT is coupled to the second node N2, and a second electrode (e.g., drain or source) of the driving transistor DTFT is coupled to the third node N3. The driving transistor DTFT may provide a driving current under the control of the voltage of the first node N1. In an embodiment of the present disclosure, the driving transistor DTFT is a P-type transistor (PMOSFET). In a case that the voltage of the second node N2 (the first electrode of the driving transistor DTFT) is higher than the voltage of the third node N3 (the second electrode of the driving transistor DTFT), the first electrode of the driving transistor DTFT is the source, and the second electrode is the drain. In this way, the driving current of the driving transistor DTFT is related to the voltage difference between the first node N1 and the second node N2. In a case that the voltage of the second node N2 (the first electrode of the driving transistor DTFT) is lower than the voltage of the third node N3 (the second electrode of the driving transistor DTFT), the first electrode of the driving transistor DTFT is the drain, and the second electrode is the source. Accordingly, the driving current of the driving transistor DTFT is related to the voltage difference between the first node N1 and the third node N3.

The data signal write circuit 20 may be coupled to a strobe signal input terminal, a data signal input terminal, and the third node N3, respectively. The data signal write circuit 20 may provide a data signal Data from the data signal input terminal to the third node N3 under the control of a strobe signal Gate from the strobe signal input terminal.

The compensation circuit 30 may be coupled to the strobe signal input terminal, the second node N2, and the first node N1, respectively. The compensation circuit 30 may couple the second node N2 to the first node N1 under the strobe signal Gate from the strobe signal input terminal, such that a current path can be formed.

The voltage supply circuit 40 may be coupled to the control signal input terminal, the first voltage signal input terminal, and the second node N2, respectively. The voltage supply circuit 40 may provide the first voltage signal ELVDD from the first voltage signal input terminal to the second node N2 under the control of the control signal EM from the control signal input terminal.

The control circuit 50 may be coupled to the control signal input terminal, the third node N3, and the anode of the light emitting device D, respectively. The control circuit 50 may provide the driving current provided by the driving transistor DTFT to one end (for example, the anode) of the light emitting device D under the control of the control signal EM from the control signal input terminal. In the embodiment of the present disclosure, when the data signal write circuit 20 operates, the control circuit 50 may be controlled to be turned off, to prevent the data signal Data from being outputted to the anode of the light emitting device D, such that the light emitting device D emits light.

The light emitting device D may be coupled to the control circuit 50 via one end (for example, the anode), and may be coupled to the second voltage signal input terminal via the other end (e.g., the cathode) to receive the second voltage signal ELVSS. The light emitting device D may emit light according to the driving current provided by the driving transistor DTFT under the control of the control circuit 50 (for example, when the control circuit 50 is turned on).

In the embodiment of the present disclosure, the first node N1 and one end of the light emitting device D can be initialized by the reset circuit 10. Under the control of the strobe signal Gate, the data signal Data is provided to the third node N3 by the data signal write circuit 20 such that the voltage of the third node N3 is higher than the voltage of the second node N2, and the driving current provided by the driving transistor DTFT flows from the third node N3 to the second node N2. Further, the second node N2 is coupled to the first node N1 by the compensation circuit 30, and the driving current provided by the driving transistor DTFT flows from the second node N2 to the first node N1 to increase the voltage of the first node N1. The voltage of the data signal is Vdata. After the voltage of the first node N1 increases to VData+Vth, the driving transistor DTFT is turned off, where Vth is threshold voltage of the driving transistor DTFT. Then, under the control of the control signal EM, the first voltage signal ELVDD is provided to the second node N2 by the voltage supply circuit 40, such that the direction of the current provided by the driving transistor DTFT is changed, flowing from the second node N2 to the third node N3. The current provided by the driving transistor DTFT is related to the voltage difference between the gate-source voltage (the difference between the voltage of the first node (VData+Vth) and the voltage of the second node (ELVDD)) and the threshold voltage Vth, that is, VData+Vth−ELVDD−Vth=VData−ELVDD. Therefore, the light emitting device D emits light according to the driving current.

Therefore, with a low gray scale, during light emission, the driving current is in no relationship with the threshold voltage of the driving transistor DTFT, thereby avoiding the influence of the luminance unevenness on the display due to the deviation and drift of the threshold voltage of the driving transistor DTFT. As the difference between the voltage of the first node N1 (Data+Vth) and the voltage of the second node N2 (ELVDD) is small, the leakage current may be reduced in the compensation circuit 30, thereby improving the voltage holding capability of the first node N1. Therefore, the voltage of the control electrode of the driving transistor DTFT is stable, such that the light emitting device D can emit light stably. In addition, the writing position of the data signal Data is one end of the driving transistor DTFT which is close to the light emitting device D. Therefore, the difficulty in the layout of the pixel circuitry can be reduced.

Figure 4:
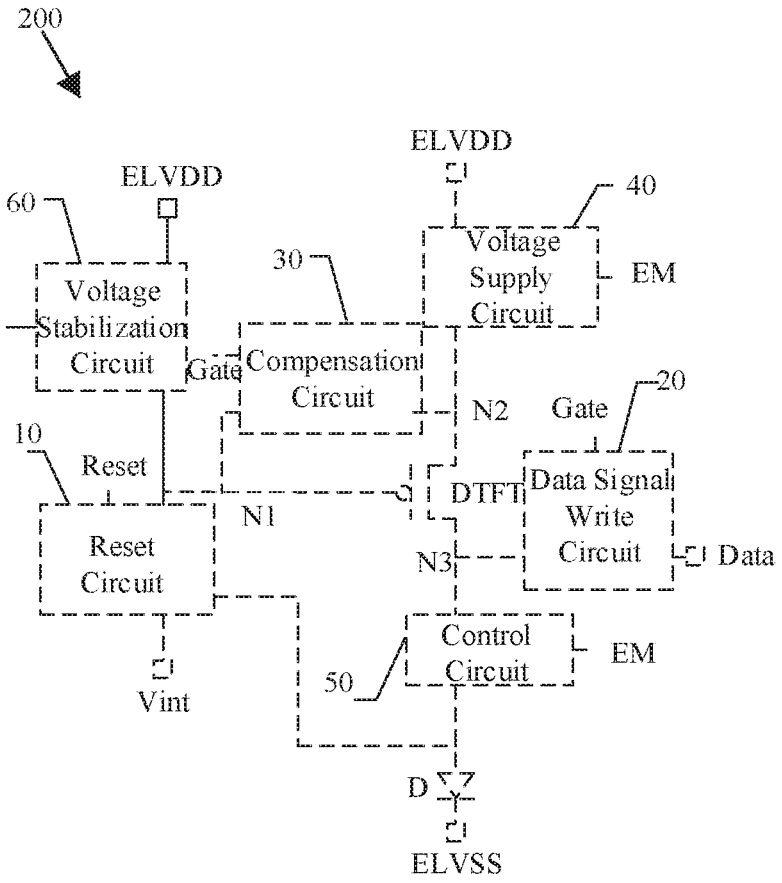
FIG. 4 is a schematic block diagram of a pixel circuitry according to another embodiment of the present disclosure.

FIG. 4 shows a schematic block diagram of a pixel circuitry according to some other embodiments of the present disclosure. As shown in FIG. 4, the pixel circuitry 200 may include a reset circuit 10, a driving transistor DTFT, a data signal write circuit 20, a compensation circuit 30, a voltage supply circuit 40, a control circuit 50, a light emitting device D, and a voltage stabilization circuit 60. The voltage stabilization circuit 60 may be coupled to the first voltage signal input terminal and the first node N1 to stabilize the voltage of the first node N1. Except for this, the pixel circuitry 200 in FIG. 4 has the same structure as the pixel circuitry 100 in FIG. 3 and may not be described in detail.

The voltage stabilization circuit 60 may stabilize the voltage of the first node N1, thereby stabilizing the voltage of the control electrode of the driving transistor DTFT. Therefore, the light emitting device D can emit light more stably.

Figure 5:
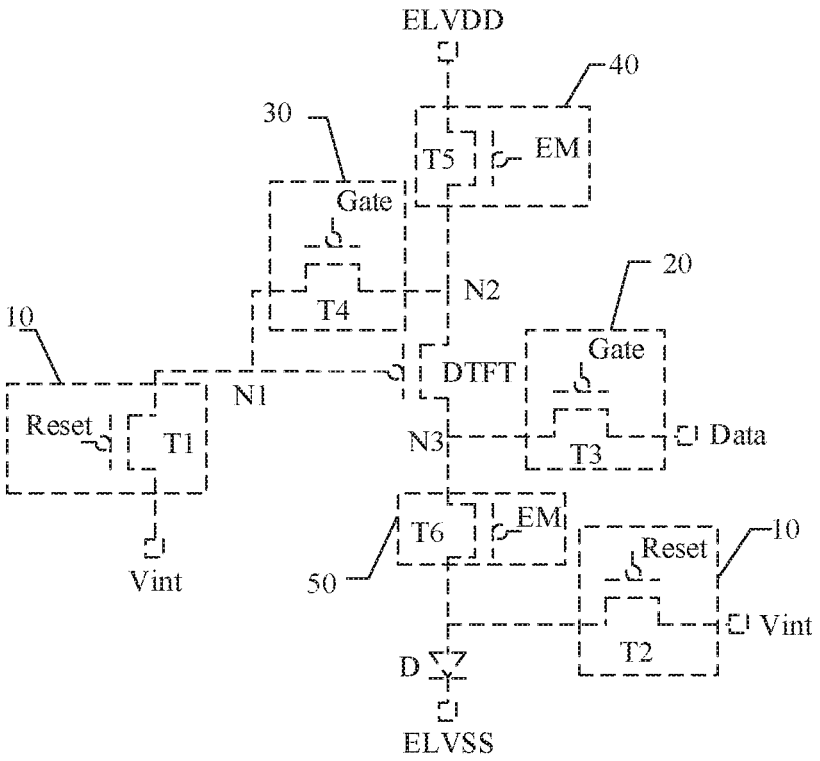
FIG. 5 is an exemplary circuit diagram of a pixel circuitry according to an embodiment of the present disclosure.

FIG. 5 illustrates an exemplary circuit diagram of a pixel circuitry according to an embodiment of the present disclosure. The pixel circuitry for example is the pixel circuitry 100 illustrated in FIG. 3. In an embodiment, the transistor may be an N-type transistor or a P-type transistor. Specifically, the transistor may be an N-type or P-type field effect transistor (MOSFET), or an N-type or P-type bipolar transistor (BJT). In an embodiment of the present disclosure, the gate of the transistor can be referred to as the control electrode. Since the source and the drain of the transistor are symmetrical, the source and the drain are not distinguished, that is, the source of the transistor may be referred to as the first electrode (or the second electrode), and the drain may be referred to as the second electrode (or the first electrode).

In the embodiment of the present disclosure, a P-type field effect transistor (PMOS) can be taken as an example for illustrative description.

As shown in FIG. 5, the reset circuit 10 may include a first transistor T1 and a second transistor T2. The control electrode of the first transistor T1 is coupled to the reset signal input terminal Reset, the first electrode of the first transistor T1 is coupled to the initialization signal input terminal Vint, and the second electrode of the first transistor T1 is coupled to the first node N1. The control electrode of the second transistor T2 is coupled to the reset signal input terminal Reset, the first electrode of the second transistor T2 is coupled to the initialization signal input terminal Vint, and the second electrode of the second transistor T2 is coupled to the anode of the light emitting device D. When the reset signal provided by the reset signal input terminal Reset is a low level signal, the first transistor T1 and the second transistor T2 are turned on. After the first transistor T1 and the second transistor T2 are turned on, an initialization signal received from the initialization signal input terminal Vint may be provided to the first node N1 and the anode of the light emitting device D, respectively. Therefore, before the data signal of the next frame of is written, the voltage signal of the previous frame can be cleared, and the voltages of the first node N1 and the anode of the light emitting device D can be provided with the voltage of the initialization signal, so as to avoid affecting the writing of the data signals.

The data signal write circuit 20 may include a third transistor T3. A control electrode of the third transistor T3 is coupled to the strobe signal input terminal Gate, a first electrode of the third transistor T3 is coupled to the data signal input terminal Data, and a second electrode of the third transistor T3 is coupled to the third node N3. When the strobe signal provided by the strobe signal input terminal Gate is a low level signal, the third transistor T3 is turned on.

The compensation circuit 30 may include a fourth transistor T4. A control electrode of the fourth transistor T4 is coupled to the strobe signal input terminal Gate, a first electrode of the fourth transistor T4 is coupled to the second node N2, and a second electrode of the fourth transistor T4 is coupled to the first node N1. When the strobe signal provided by the strobe signal input terminal Gate is a low level signal, the fourth transistor T4 is turned on.

The voltage supply circuit 40 may include a fifth transistor T5. A control electrode of the fifth transistor T5 is coupled to the control signal input terminal EM, a first electrode of the fifth transistor T5 is coupled to the first voltage signal input terminal ELVDD, and a second electrode of the fifth transistor T5 is coupled to the second node N2. When the control signal provided by the control signal input terminal EM is a low level signal, the fifth transistor T5 is turned on.

The control circuit 50 may include a sixth transistor T6. A control electrode of the sixth transistor T6 is coupled to the control signal input terminal EM, a first electrode of the sixth transistor T6 is coupled to the third node N3, and a second electrode of the sixth transistor T6 is coupled to the anode of the light emitting device D. When the control signal provided by the control signal input terminal EM is a low level signal, the sixth transistor T6 is turned on.

The light emitting device D is a light emitting diode, such as an organic light emitting diode (OLED), an active matrix organic light emitting diode (AMOLED), and the like.

In addition, an N-type transistor can also be employed to implement the above circuit structure. Accordingly, a high level signal may be employed to control the respective circuits to be turned on or off.

Figure 6:
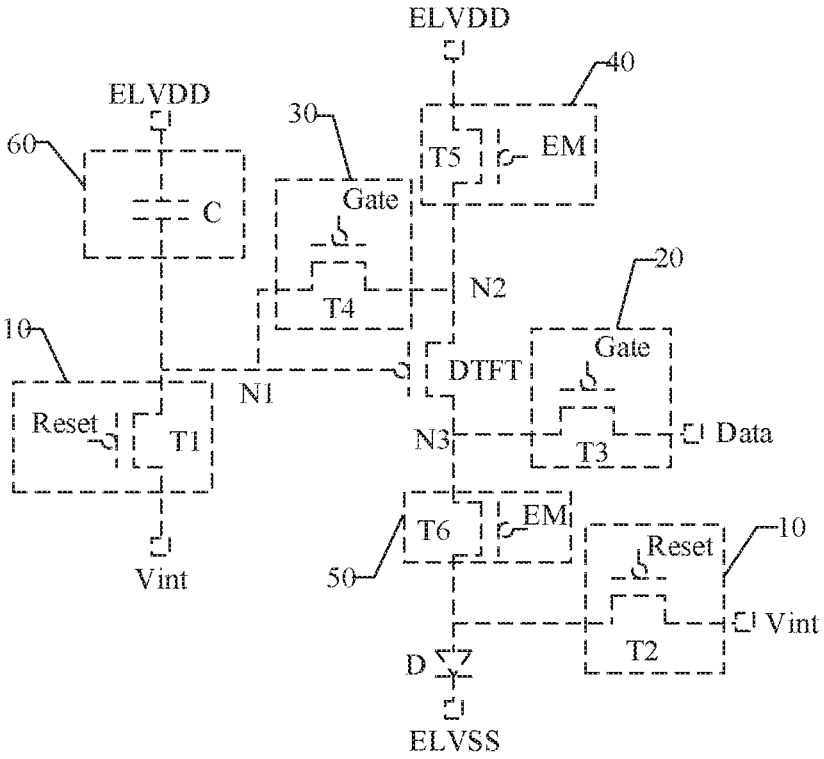
FIG. 6 is an exemplary circuit diagram of a pixel circuitry according to an embodiment of the present disclosure.

FIG. 6 shows an exemplary circuit diagram of a pixel circuitry according to an embodiment of the present disclosure. The pixel circuitry, for example, is the pixel circuitry 200 shown in FIG. 4. In an embodiment, the transistor may be an N-type transistor or a P-type transistor. Specifically, the transistor may be an N-type or P-type field effect transistor (MOSFET), or an N-type or P-type bipolar transistor (BJT). In an embodiment of the present disclosure, the gate of the transistor can be referred to as the control electrode. Since the source and the drain of the transistor are symmetrical, the source and the drain are not distinguished, that is, the source of the transistor may be referred to as the first electrode (or the second electrode), and the drain may be referred to as the second electrode (or the first electrode).

In the embodiment of the present disclosure, a P-type field effect transistor (PMOS) is taken as an example for illustrative description.

As shown in FIG. 6, the voltage stabilization circuit 60 may include a capacitor C. A plate of the capacitor C can be coupled to the first voltage signal input terminal ELVDD, and the other plate of the capacitor C can be coupled to the first node N1. The capacitor C can be configured to store electrical energy. Since it takes some time to charge and discharge the capacitor C, the voltage across the capacitor C may not change. Therefore, the capacitor C may be configured to stabilize the voltage.

Other portions of the pixel circuitry shown in FIG. 6 have been described above and may not be described again.

Figure 7:
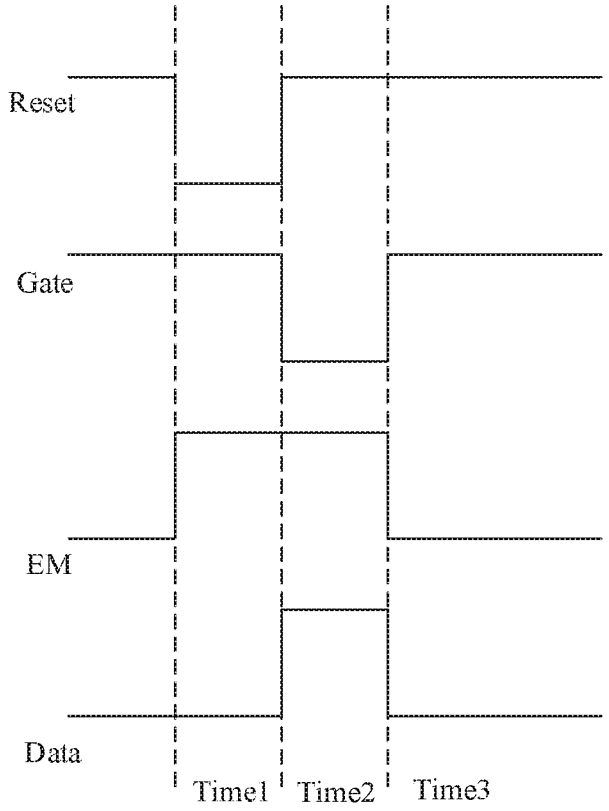
FIG. 7 is a timing diagram of signals in a pixel circuitry according to an embodiment of the present disclosure.

FIG. 7 shows a timing diagram of signals in a pixel circuitry according to an embodiment of the present disclosure. In the following, with respect to the timing relationship of the signals, in conjunction with the schematic equivalent circuit diagram of the pixel circuitry shown in each of the phases shown in FIGS. 8-10, the operating process of the pixel circuitry is briefly described.

Figure 8:
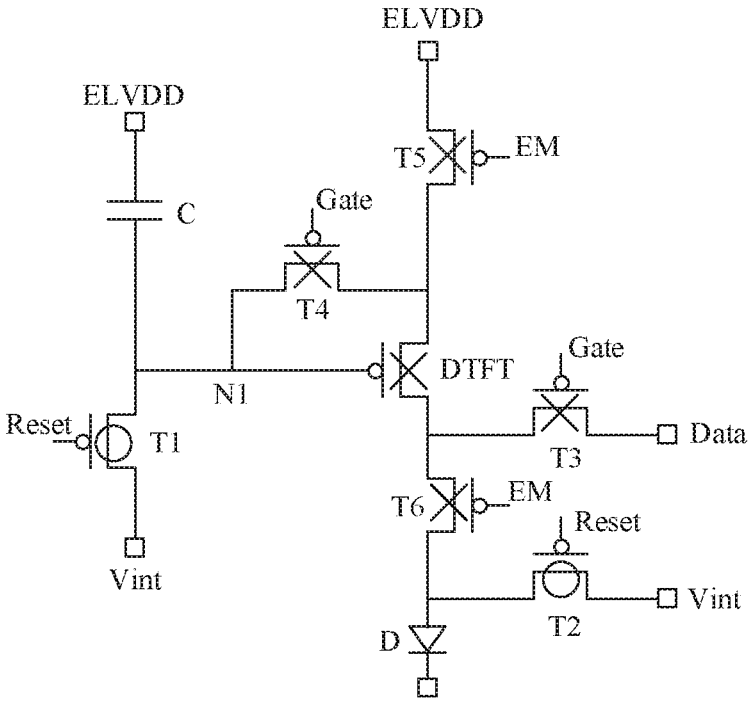
FIG. 8 is an equivalent circuit diagram of a pixel circuitry in a first phase according to an embodiment of the present disclosure.

In the first phase Time1 (initialization phase), the reset signal Reset and the data signal Data are at a low level, and the strobe signal Gate and the control signal EM are at a high level. The first transistor T1 and the second transistor T2 are turned on. The third transistor T3, the fourth transistor T4, the fifth transistor T5, the driving transistor DTFT, and the sixth transistor T6 are all turned off. The schematic equivalent circuit diagram is shown in FIG. 8. "○" indicates turn-on, and "X" indicates turn-off. In the Time1 phase, the initialization signal input terminal Vint provides an initialization signal. The initialization signal is provided to the first node N1 by the first transistor T1 to reset the voltage of the first node N1. Further, the initialization signal is provided to the anode of the light emitting device D by the second transistor T2 to reset the voltage of the anode of the light emitting device D. In the example, the voltage of the initialization signal can be referred to as Vvint, thus the voltage of the first node N1 and the voltage the anode of the light emitting device D are both Vvint, for example, at a low level.

Figure 9:
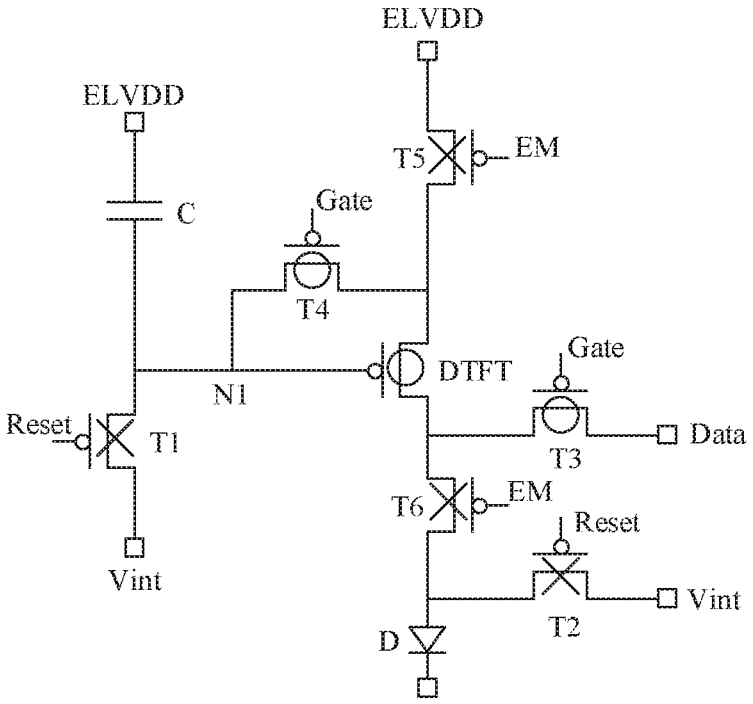
FIG. 9 is an equivalent circuit diagram of the pixel circuitry in a second phase according to an embodiment of the present disclosure.

In the second phase Time2 (compensation phase), the strobe signal Gate is at a low level, and the reset signal Reset, the control signal EM, and the data signal Data are at a high level. The third transistor T3 and the fourth transistor T4 are turned on. The first transistor T1, the second transistor T2, the fifth transistor T5, and the sixth transistor T6 are turned off. The schematic equivalent circuit diagram is shown in FIG. 9, "○" indicates turn-on, and "X" indicates turn-off. In the Time2 phase, the data signal input terminal Data provides a data signal. The data signal is provided to the third node N3 via the third transistor T3. In this way, the voltage of the second electrode of the driving transistor DTFT is higher than the voltage of the first electrode of the driving transistor DTFT, and thus the second electrode of the driving transistor DTFT coupled to the third node N3 is the source. Initially, the voltage of the gate of the driving transistor DTFT is provided with the voltage of the initialization signal Vvint (for example, a low level). The driving transistor DTFT is turned on, as the voltage difference between the gate and the source of the driving transistor DTFT is high. The driving current provided by the driving transistor DTFT flows from the third node N3 to the second node N2, and further flows to the first node N1, to increase the voltage of the first node N1. The voltage of the data signal is referred to as Vdata. When the voltage of the first node N1 rises to VData+Vth, the driving transistor DTFT is turned off, where Vth is the threshold voltage of the driving transistor DTFT.

Figure 10:
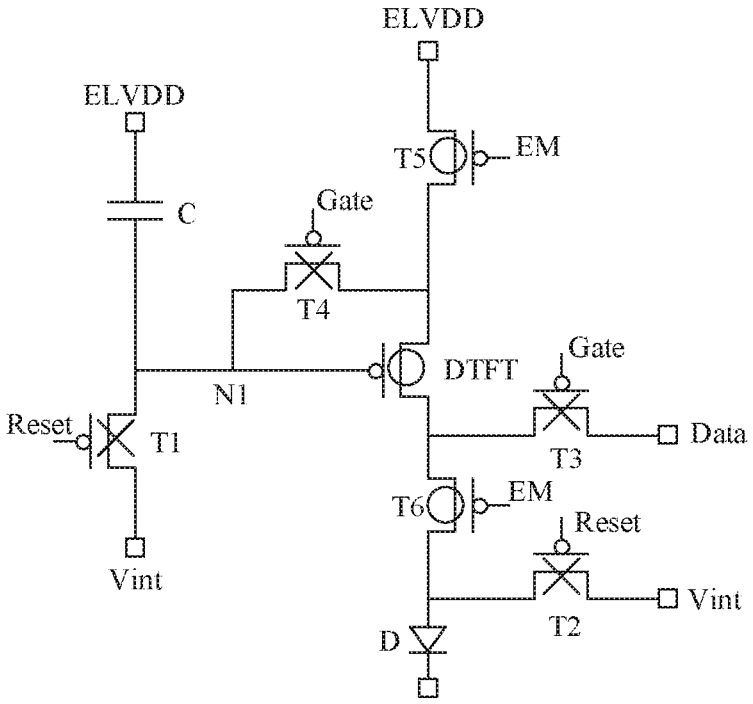
FIG. 10 is an equivalent circuit diagram of the pixel circuitry in a third phase according to an embodiment of the present disclosure.

In the third phase Time3 (light emission phase), the control signal EM and the data signal Data are at a low level, and the reset signal Reset and the strobe signal Gate are at a high level. The fifth transistor T5, the driving transistor DTFT, and the sixth transistor T6 are turned on. The first transistor T1, the second transistor T2, the third transistor T3, and the fourth transistor T4 are all turned off. The schematic equivalent circuit diagram is shown in FIG. 10, "○" indicates turn-on, and "X" indicates turn-off. In the Time3 phase, the first voltage signal input terminal ELVDD provides the first voltage signal to the second node N2, and the first electrode of the driving transistor DTFT coupled to the second node N2 becomes the source. The direction of the driving current provided by the driving transistor DTFT changes. The driving current flows from the second node N2 to the third node N3, and is provided to the light emitting device D via the sixth transistor T6. The light emitting device D emits light according to the driving current. The voltage of the first voltage signal is VELVDD, and the voltage of the second node N2 is VELVDD. The voltage of the first node N1 maintains the voltage of the Time2 phase, that is, VData+Vth. The driving current IOLED can be calculated as $IOLED=\mu CoxW(Vgs-Vth)^2/(2\ L)$. Where $Vgs=Vg-Vs=VData+Vth-VELVDD$, thus $Vgs-Vth=VData+Vth-VELVDD-Vth=VData-VELVDD$, $IOLED=\mu CoxW(VData-VELVDD)^2/(2\ L)$. Thereby, the driving current IOLED is not affected by the threshold voltage of the driving transistor DTFT, and the stability of emitted light can be further improved. In the case of a low gray scale, the IOLED is required to be small. Therefore, a smaller IOLED can be achieved by controlling the difference between VData and VELVDD to be small. As the voltage difference between the first node N1 and the second node N2 is reduced, the leakage current of the fourth transistor T4 may be reduced.

According to an embodiment of the present disclosure, by setting the compensation circuit 30 between the first node N1 and the second node N2 of the pixel circuit, when the compensation circuit 30 is turned on, the second node N2 is coupled to the first node N1, and when the voltage supply circuit 40 is turned on, the first voltage signal is provided to the second node N2. Therefore, with a low gray scale, in the light emission process, the voltage difference across the compensation circuit 30 is small, and the leakage of the compensation circuit 30 may be reduced. In this way, it is advantageous to increase the voltage holding ability of the first node N1, such that the voltage of the control electrode of the driving transistor DTFT is stable, thereby making the light emitting device D emit light stably. In addition, the writing position of the data signal is the end of the driving transistor DTFT close to the light emitting device D, which may reduce the difficulty in the layout of the pixel circuitry. By providing the reset circuit 10, the voltages of the first node N1 and the anode of the light emitting device D are cleared, and the voltages of the first node N1 and the anode of the light emitting device D are the voltage of the initialization signal, so as to avoid affecting the writing of data signal of the next frame. Further, by setting the voltage stabilization circuit 60, the voltage of the first node N1 can be stabilized, such that the light emitting device D emits light more stably.

Figure 11:
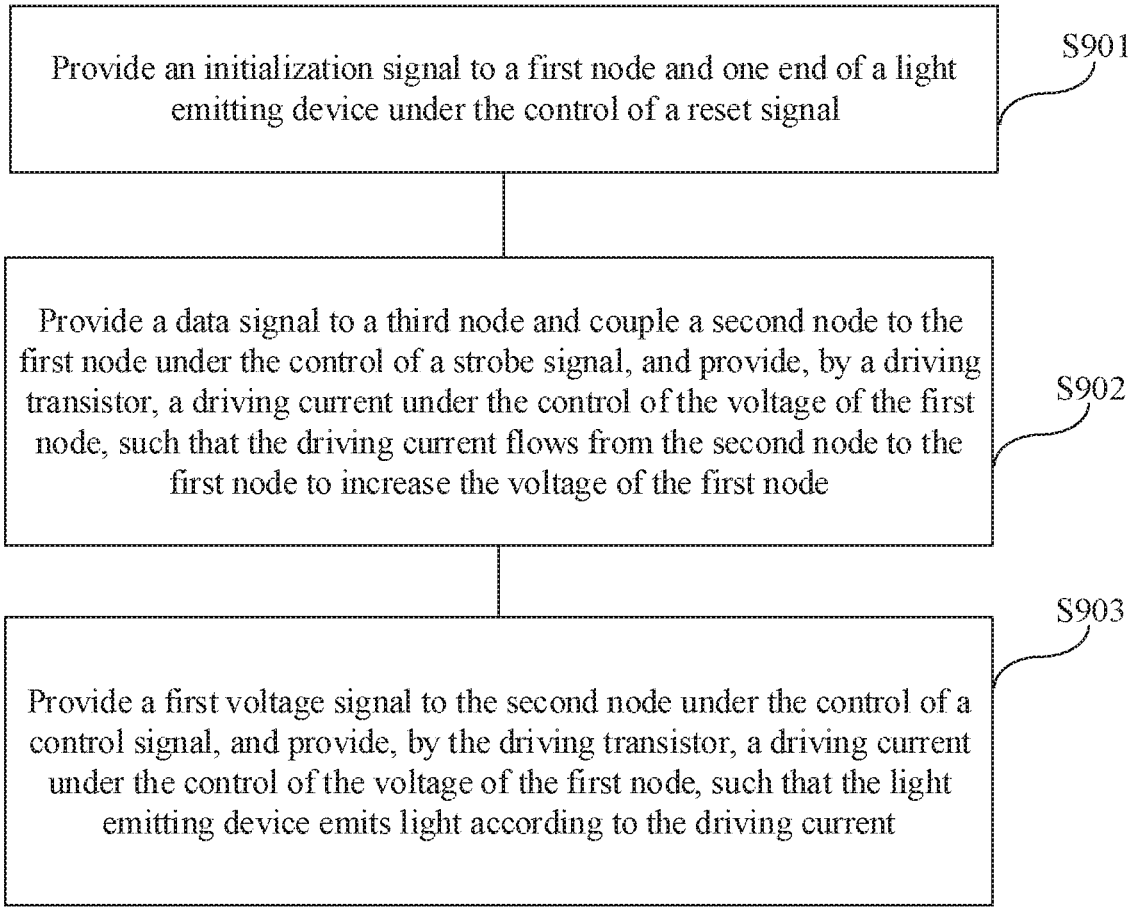
FIG. 11 is a schematic flowchart of a driving method according to an embodiment of the present disclosure.

FIG. 11 illustrates a method for driving a pixel circuitry according to an embodiment of the present disclosure. For example, the pixel circuitry may include the pixel circuitry 100 and the pixel circuitry 200 described above, and the like. As shown in FIG. 11, the method includes the following.

Step S901: an initialization signal from an initialization signal input terminal is provided to a first node and one end of a light emitting device under the control of a reset signal from a reset signal input terminal. Therefore, the voltage of the first node and the voltage of one end of the light emitting device can be initialized.

This step corresponds to the first phase Time1 of the above embodiment.

Step S902: Under the control of a strobe signal from a strobe signal input terminal, a data signal from a data signal input terminal is provided to a third node, and a second node is coupled to the first node. Under the control of the voltages of the first node and the third node, a driving current is provided by a driving transistor, such that the driving current flows from the third node to the second node, and then flows to the first node, to increase the voltage of the first node.

This step corresponds to the second phase Time2 of the above embodiment.

Step S903: a first voltage signal from a first voltage signal input terminal is provided to the second node under the control of a control signal from a control signal input terminal. Under the control of the voltages of the first node and the second voltage, a driving current is provided by the driving transistor. The direction of the driving current changes, such that the driving current flows from the second node to the third node. The light emitting device emits light according to the driving current.

This step corresponds to the third phase Time3 of the above embodiment.

As above, in the method of the embodiment of the present disclosure, the voltages of the first node and the anode of the light emitting device are cleared by the step S901, and the voltages of the first node and the anode of the light emitting device are the voltage of the initialization signal, so as to avoid affecting the writing of data signals. Through step S902, a data signal is provided and the voltage of the first node is increased. Through step S903, the first voltage signal is provided to the second node. Under a condition of a low gray scale, during the light emission process, the voltage difference across the compensation circuit is small, and the leakage current in the compensation circuit may be reduced. Therefore, it can increase the voltage holding ability of the first node, such that the voltage of the control electrode of the driving transistor is stabilized. Further, the driving current provided from the driving transistor is independent of its threshold voltage, thereby avoiding the influence of luminance unevenness caused by the deviation or drift of the threshold voltage, such that the light emitting device can emit light more stably.

According to an embodiment of the present disclosure, an array substrate including a plurality of the above pixel circuits is also provided. In an embodiment, the plurality of pixel circuits may be arranged in an array.

In another embodiment of the present disclosure, a display device including the above array substrate is provided. The display device may be, for example, a display screen, a mobile phone, a tablet computer, a camera, a wearable device, or the like.

In this document, relational terms such as first and second are used merely to distinguish one entity or operation from another entity or operation, and do not necessarily require or imply any such actual relationship or order between these entities or operations. Furthermore, the terms "comprise," "include," or any other variant thereof are intended to cover non-exclusive inclusions, such that a process, method, item, or terminal device that includes a series of elements includes not only those elements, but also other elements that are not explicitly listed, or elements inherent in such a process, method, item, or terminal device. In the absence of further restrictions, the element defined by the statement "comprising one . . . " does not exclude the existence of additional identical elements in a process, method, item, or terminal device that includes the element.

Several embodiments of the present disclosure have been described in detail above, but the scope of protection of the present disclosure is not limited thereto. It can be apparent to those skilled in the art that various modifications, substitutions, and variations of the embodiments of the present disclosure may be made without departing from the spirit and scope of the present disclosure. The scope of protection of the present disclosure is defined by the appended claims.

What is claimed is:

1. A pixel circuitry consisting of a reset circuit, a driving transistor, a data signal write circuit, a compensation circuit, a voltage supply circuit, a control circuit, and a light emitting device;

wherein the reset circuit is configured to provide an initialization signal from an initialization signal input terminal to a first node and one end of the light emitting device under the control of a reset signal from a reset signal input terminal, wherein the reset circuit comprises a first transistor and a second transistor, wherein a control electrode of the first transistor is coupled to the reset signal input terminal, wherein a first electrode of the first transistor is coupled to the initialization signal input terminal, wherein a second electrode of the first transistor is coupled to the first node, wherein a control electrode of the second transistor is coupled to the reset signal input terminal, wherein a first electrode of the second transistor is coupled to the initialization signal input terminal, and wherein a second electrode of the second transistor is coupled to the light emitting device;

wherein a control electrode of the driving transistor is coupled to the first node, wherein a first electrode of the driving transistor is coupled to a second node, wherein a second electrode of the driving transistor is coupled to a third node, and wherein the driving transistor is configured to provide a driving current under the control of a voltage of the first node;

wherein the data signal write circuit is configured to provide a data signal from a data signal input terminal to the third node under the control of a strobe signal from a strobe signal input terminal;

wherein the compensation circuit is configured to couple the second node to the first node under the control of the strobe signal;

wherein the voltage supply circuit is configured to provide a first voltage signal from a first voltage signal input terminal to the second node under the control of a control signal from a control signal input terminal;

wherein the control circuit is configured to provide a driving current provided by the driving transistor to the light emitting device under the control of the control signal; and wherein the light emitting device is configured to emit light according to the driving current.

2. The pixel circuitry according to claim 1, wherein the data signal write circuit comprises:

a third transistor, wherein a control electrode of the third transistor is coupled to the strobe signal input terminal, wherein a first electrode of the third transistor is coupled to the data signal input terminal, and wherein a second electrode of the third transistor is coupled to the third node.

3. The pixel circuitry according to claim 1, wherein the compensation circuit comprises:

a fourth transistor, wherein a control electrode of the fourth transistor is coupled to the strobe signal input terminal, wherein a first electrode of the fourth transistor is coupled to the second node, and wherein a second electrode of the fourth transistor is coupled to the first node.

4. The pixel circuitry according to claim 1, wherein the voltage supply circuit comprises:

a fifth transistor, wherein a control electrode of the fifth transistor is coupled to the control signal input terminal, wherein a first electrode of the fifth transistor is coupled to the first voltage signal input terminal, and wherein a second electrode of the fifth transistor is coupled to the second node.

5. The pixel circuitry according to claim 1, wherein the control circuit comprises:

a sixth transistor, wherein a control electrode of the sixth transistor is coupled to the control signal input terminal, wherein a first electrode of the sixth transistor is coupled to the third node, and wherein a second electrode of the sixth transistor is coupled to the light emitting device.

6. A method for driving a pixel circuitry according to claim 1, the method comprising:

providing an initialization signal from an initialization signal input terminal to a first node and one end of a light emitting device under the control of a reset signal from a reset signal input terminal;

providing a data signal from a data signal input terminal to a third node and coupling a second node to the first node under the control of a strobe signal from a strobe signal input terminal, and providing, by a driving transistor, a driving current under the control of the voltage of the first node, such that the driving current flows from the second node to the first node to increase the voltage of the first node; and providing a first voltage signal from a first voltage signal input terminal to the second node under the control of a control signal from a control signal input terminal, and providing, by the driving transistor, a driving current under the control of the voltage of the first node, such that the light emitting device emits light according to the driving current.

7. An array substrate comprising a plurality of pixel circuits according to claim 1.

8. A display device comprising the array substrate according to claim 7.

9. The array substrate according to claim 7, the pixel circuitry further comprising a voltage stabilization circuit configured to stabilize the voltage of the first node.

10. A pixel circuitry consisting of:

a first transistor, wherein a control electrode of the first transistor is coupled to a reset signal input terminal, wherein a first electrode of the first transistor is coupled to an initialization signal input terminal, and wherein a second electrode of the first transistor is coupled to a first node;

a driving transistor, wherein a control electrode of the driving transistor is coupled to the first node, wherein a first electrode of the driving transistor is coupled to a second node, and wherein a second electrode of the driving transistor is coupled to a third node;

a second transistor, wherein a control electrode of the second transistor is coupled to the reset signal input terminal, wherein a first electrode of the second transistor is coupled to the initialization signal input terminal, and wherein a second electrode of the second transistor is coupled to a light emitting device;

a third transistor, wherein a control electrode of the third transistor is coupled to a strobe signal input terminal, wherein a first electrode of the third transistor is coupled to a data signal input terminal, and wherein a second electrode of the third transistor is coupled to the third node;

a fourth transistor, wherein a control electrode of the fourth transistor is coupled to the strobe signal input terminal, wherein a first electrode of the fourth transistor is coupled to the second node, and wherein a second electrode of the fourth transistor is coupled to the first node;

a fifth transistor, wherein a control electrode of the fifth transistor is coupled to a control signal input terminal, wherein a first electrode of the fifth transistor is coupled to a first voltage signal input terminal, and wherein a second electrode of the fifth transistor is coupled to the second node;

a sixth transistor, wherein a control electrode of the sixth transistor is coupled to the control signal input terminal, wherein a first electrode of the sixth transistor is coupled to the third node, and wherein a second electrode of the sixth transistor is coupled to the light emitting device; and a light emitting device, wherein one end of the light emitting device is coupled to the second electrode of the sixth transistor.

11. An array substrate comprising a plurality of pixel circuits according to claim 10.

* * * * *